US007033016B2

(12) United States Patent
Yoshida et al.

(10) Patent No.: US 7,033,016 B2
(45) Date of Patent: Apr. 25, 2006

(54) INK-JET RECORDING MEDIUM

(75) Inventors: Yoshio Yoshida, Tokyo (JP); Shoichi Endo, Tokyo (JP); Kinya Tamura, Tokyo (JP); Takashi Yamaguchi, Tokyo (JP); Tsuyoshi Yasuda, Tokyo (JP)

(73) Assignee: Nippon Paper Industries Co. Ltd., Tokyo (JP)

( * ) Notice: Subject to any disclaimer, the term of this patent is extended or adjusted under 35 U.S.C. 154(b) by 0 days.

(21) Appl. No.: 10/472,845

(22) PCT Filed: Mar. 26, 2002

(86) PCT No.: PCT/JP02/02936

§ 371 (c)(1),
(2), (4) Date: Sep. 26, 2003

(87) PCT Pub. No.: WO02/076756

PCT Pub. Date: Oct. 3, 2002

(65) Prior Publication Data

US 2004/0115369 A1 Jun. 17, 2004

(30) Foreign Application Priority Data

Mar. 27, 2001 (JP) ..... 2001-089243
Mar. 29, 2001 (JP) ..... 2001-094867

(51) Int. Cl.
*B41J 2/01* (2006.01)

(52) U.S. Cl. ..... 347/105; 347/101; 428/32.1

(58) Field of Classification Search ..... 347/105, 347/101, 100; 428/195, 32.1
See application file for complete search history.

(56) References Cited

U.S. PATENT DOCUMENTS

| | | | | |
|---|---|---|---|---|
| 5,863,648 | A * | 1/1999 | Ohmura et al. | 428/32.1 |
| 5,882,754 | A | 3/1999 | Kuroyama et al. | |
| 6,403,198 | B1 * | 6/2002 | Urasaki | 428/32.28 |
| 2001/0016249 | A1 * | 8/2001 | Kitamura et al. | 347/105 |
| 2002/0064633 | A1 * | 5/2002 | Wakata et al. | 428/195 |

FOREIGN PATENT DOCUMENTS

| | | | |
|---|---|---|---|
| JP | 2274587 | A | 11/1990 |
| JP | 11115308 | A | 4/1999 |
| JP | 11192777 | A | 7/1999 |
| JP | 2001287442 | A | 10/2001 |
| JP | 2001334748 | A | 12/2001 |

* cited by examiner

*Primary Examiner*—Manish S. Shah
(74) *Attorney, Agent, or Firm*—Millen, White, Zelano & Branigan, P.C.

(57) ABSTRACT

An inkjet recording medium having a recording layer including a pigment and a polyvinyl alcohol on an air-permeable support, wherein inkjet recording medium is made by coating a treatment solution on the recording layer, wherein the treatment solution has the action of solidifying the polyvinyl alcohol in the recording layer when it is in the wet state, and then bringing the recording layer into pressure contact with a heated mirror surface while it is still wet. This treatment solution is a mixed solution of borate/boric acid, wherein the blending ratio of the borate and boric acid in the treatment solution is 0.25/1 to 2/1 by weight ratio.

20 Claims, No Drawings

INK-JET RECORDING MEDIUM

FIELD OF THE INVENTION

This invention relates to an inkjet recording medium which is suitable not only for printing with dye inks but also with pigment inks, and in particular to an inkjet recording medium which has excellent continuous operation properties and can obtain a glossiness of the same level as that obtained with silver halide photographic papers.

BACKGROUND OF THE PRIOR ART

In inkjet recording, recording is accomplished by ejecting small ink droplets by various mechanisms to form dots by adhesion on a recording paper. Unlike the dot impact recording method, there is no noise, it is easy to form a full-color image and printing can be performed at high speed.

However, the inks used for inkjet recording were aqueous inks using ordinary direct dyes or acidic dyes which did not easily dry out. Thus the properties required of the inkjet recording paper used for this inkjet recording method were that it allowed high-speed drying of the ink, that it gave a high printing density, and that there was no bleeding or smudging of ink, nor lenticulation of the recording paper due to ink absorption. Methods of manufacturing a high-quality inkjet recording paper satisfying these requirements by cast coating have already been proposed (Japanese Patent Application Public Disclosure Sho 62-95285, 63-264391, Japanese Patent Application Public Disclosure Hei 2-274587 and 5-59694 (all Koho)). In all these methods, a cast coating paper with high gloss is obtained by simultaneously transferring a recording layer comprising a pigment having a synthetic silica as its main component and a binder under pressure to a heated mirror surface in a wet state before it has dried so as to transfer a mirror finish, and drying. However, the gloss of the outermost layer thus formed was low, and a glossiness of the same quality as that of a silver halide photographic paper could not be obtained.

On the other hand, an inkjet recording paper of similar quality to that for silver halide photography, comprising a recording layer having a hydrophilic binder such as polyvinyl alcohol or gelatine and inorganic fine particles on a resin-coated paper ("RC paper"), comprising a coating layer of polyolefin with a white pigment on at least one surface of a base paper, has been proposed (Japanese Patent Application Public Disclosure Hei 10-119423 (Koho), Japanese Patent Application Public Disclosure Hei 11-20306 (Koho)). However, in the case of these inkjet recording papers, a resin-coated paper which is not air-permeable is used as a support, so some time was required for drying after coating the recording layer, and productivity was extremely low.

The Inventors, as a result of intensive studies of the above disadvantages, found that an extremely good inkjet recording medium of similar quality to that of silver halide photographic papers could be obtained by applying a recording layer comprising polyvinyl alcohol, treating the recording layer surface with a mixed solution of borate/borate acid while it was still in the wet state, and bringing it into pressure contact with the heated mirror surface while the recording layer was still in the wet state. Particularly good results were obtained by using two types of polyvinyl alcohol having different average saponification degrees. They thereby arrived at the present invention.

It is therefore an object of this invention to provide a glossy inkjet recording medium of the same quality to that of silver halide photographic papers having good inkjet recording properties and excellent productivity.

DISCLOSURE OF THE INVENTION

The above object of the invention is attained by an inkjet recording medium with gloss on the recording layer surface, wherein a recording layer comprising a pigment and a polyvinyl alcohol is prepared, a treatment solution is coated onto this recording layer, and the recording layer is brought into pressure contact with a heated mirror surface while the recording layer is still in the wet state, this treatment solution being a mixed solution of borate/borate acid. In this invention, it is preferred that the polyvinyl alcohol is a mixture comprising a polyvinyl alcohol (A) of average saponification degree 86–90 and a polyvinyl alcohol (B) of average saponification degree 95–98 blended in a weight ratio of A:B=1–5:1. It is preferred that the average polymerization degree of this polyvinyl alcohol is 1,700–2,800, and that an alumina compound is used as the pigment in the recording layer.

DESCRIPTION OF THE PREFERRED EMBODIMENTS (Support)

The air-permeable support used in this invention may be any of those known in the art, but it is particularly preferred to use a paper (coated paper, uncoated paper, etc.). The pulp for this paper may be a chemical pulp (bleached or unbleached kraft pulp from conifers, bleached or unbleached kraft pulp from broad-leaved tree) a mechanical pulp (groundwood pulp, thermomechanical pulp, chemithermomechanical pulp), or de-inked pulp, which may be used alone or in admixture in a suitable blending ratio. The pH of this paper may be acid, neutral or alkaline. The opacity of the paper may be increased by including a filler in the paper, this filler being conveniently selected from fillers known in the art such as hydrated silicic acid, white carbon, talc, kaolin, clay, calcium carbonate, titanium oxide or a synthetic resin filler.

(Recording Layer)

The recording layer in this invention comprises a pigment, and in this invention, it is preferred to use an alumina compound as this pigment. The alumina compound used in this invention is alumina or an alumina hydrate, for example aluminium hydroxide, alumina sol, colloidal alumina, powdered alumina and pseudo boehmite. The recording layer may also contain other pigments the extent that they do not interfere with the effect of this invention, e.g., synthetic silica, kaolin, talc, calcium carbonate, titanium dioxide, clay and zinc oxide. The particle size and BET specific surface of these pigments may be conveniently adjusted as required.

The recording layer of this invention comprises polyvinyl alcohol as a binder. By using polyvinyl alcohol, the transparency of the recording layer increases, a gloss close to that of silver halide photographic paper is obtained, print density increases, and a clean-looking recorded image is obtained. The increase of print density is particularly marked using a dye ink. It is particularly preferred in this invention that the polyvinyl alcohol (A) having a saponification degree of 86–90 and the polyvinyl alcohol (B) of average saponification degree 95–98 are mixed together in a weight ratio of A:B=1:1–5:1.

The average saponification degree of the polyvinyl alcohol also influences the stability of the coating liquid and hardness of the solidified recording layer. Normally, the polyvinyl alcohol (A) having a saponification degree of 86–90 and the polyvinyl alcohol (B) of average saponification degree 95–98 are referred to as partially saponified PVA, but as the polyvinyl alcohol (B) of average saponification degree 95–98 is close to complete saponification, it is also referred to as intermediately saponified PVA.

When only the polyvinyl alcohol (A) of average saponification degree 86–90 is used, recording density during ink jet recording does not easily increase, and when only the polyvinyl alcohol (B) of average saponification degree 95–98 is used, the viscosity of the coating solution tends to increase with time. Therefore, in this invention, it is preferred to use a mixture of the PVA (A) and (B), and it is particularly preferred that the blending ratio of (A) and (B) is (A/B) is 1:1–5:1. Also, it is preferred that the average polymerization degree of these polyvinyl alcohols is 1,700–2,800. When the average polymerization degree is low, and especially when a pigment ink is used, color during printing tends to deteriorate.

The recording layer of this invention may also contain a resin component in addition to the polyvinyl alcohol provided that it does not interfere with effect of this invention, for example, a starch such as starch oxide or esterified starch, a cellulose derivative such as carboxymethylcellulose or hydroxyethylcellulose, polyvinyl pyrrolidone, casein, gelatine, soybean protein, styrene-acryl resin and its derivatives, styrene-butadiene latex, acryl emulsion, vinyl acetate emulsion, vinyl chloride emulsion, urethane emulsion, urea emulsion, and alkyd emulsions and their derivatives. The PVA accounts for 70% or more, and preferably 80% or more, of the total resin component of the recording layer. The blending amount of the resin component in the recording layer is preferably 5 weight parts-30 weight parts relative to 100 weight parts of pigment, but there is no particular limitation provided that the required coating layer strength is obtained.

(Treatment Solution)

In this invention, after applying/drying the recording layer on the support, a treatment solution (solidifying solution) which is an aqueous solution comprising both boric acid and a borate, is used.

When a borate is used alone without boric acid as the treatment solution, the polyvinyl alcohol in the recording layer solidifies excessively, so even if the recording layer is brought into pressure contact with the heated mirror surface while it is still wet, the mirror finish cannot be completely transferred and a satisfactory gloss surface cannot be obtained. Further, even if the borate concentration is decreased, it is difficult to control the degree of solidification of the polyvinyl alcohol.

Conversely, if boric acid is used alone without a borate, the polyvinyl alcohol in the recording layer does not solidify sufficiently, so the soft coating layer adheres to the boric acid roller, and it is impossible to obtain a satisfactory wet recording layer. If the boric acid concentration is increased, the polyvinyl alcohol becomes more solid, but as the solubility of boric acid is low, is difficult to obtain the desired solidification state.

Hence, in this invention, if boric acid and a borate are mixed together in the treatment solution, it is easy to obtain solidification of a suitable degree, and an ink jet recording medium having a satisfactory gloss can be obtained. Further, when a borate and boric acid are mixed together, the solubility of boric acid in water improves compared to the case where boric acid is used alone, so it becomes easier to modulate the solidification degree of the polyvinyl alcohol.

The blending ratio (borate/boric acid) of the borate and boric acid in the treatment solution is preferably in the range 0.25/1–2/1. When the blending ratio of borate/boric acid is less than 0.25/1, the proportion of boric acid becomes too large, the solidification of polyvinyl alcohol in the recording layer is too loose so that the soft coating layer adheres to the roller carrying the solidifying solution, and a satisfactory, wet coating layer cannot be obtained. On the other hand, when the blending ratio of borate/boric acid exceeds 2/1, the polyvinyl alcohol in the recording layer becomes too hard, the gloss of the recording layer surface falls and the gloss may become uneven.

The borates used in this invention mean salts of oxoacids having a boron atom as the central atom, e.g., borax, orthoboric acid, diborates, metaborates, pentaborates and octaborates, but there is no particular limitation. From the viewpoint of cost, in this invention, it is preferred to use borax. The concentration of the borates and boric acid may be conveniently adjusted as required. When the concentration of borates and boric acid increases, the polyvinyl alcohol becomes more solid, the gloss of the recording layer tends to decrease, and crystals tend to separate easily from the solidifying solution containing borates and boric acid, so the stability of the solidifying solution is impaired.

(Remover)

A remover may be added as required to the recording layer and treatment solution. When the remover has a substantially identical melting point to the surface temperature of the heated mirror surface, the performance of the remover is optimized. The melting point of the remover is preferably 90–150° C. but more preferably 95–120° C. There is no particular limitation on the remover provided that it has the above properties.

Pigment dispersants, moisture retention agents, thickeners, antifoaming agents, preservatives, colorants, waterproofing agents, humidifiers, fluorescent dyes, ultraviolet absorption agents and cationic polymer electrolytes may be added as convenient.

In this invention, the mixed solution containing borate/boric acid is applied as a treatment solution having the action of solidifying polyvinyl alcohol in the recording layer which is in the wet state when it is applied, and the recording layer which is in the wet state is then pressed in contact with the heated mirror surface to impart gloss (e.g., solid cast coating method). If the recording layer is in the dry state when the treatment solution is applied (e.g., rewet cast coating method), the mirror surface is not transferred sufficiently and fine surface imperfections tend to increase, so it may occur that the gloss obtained with a silver halide photographic paper cannot easily be obtained.

In this invention, the recording layer can be deposited on the support by any methods known in the art which use coating appliances; such as a blade coater, air knife coater, roll coater, brush coater, kiss coater, squeeze coater, curtain coater, die coater, bar coater, gravure coater or direct bar coater. Any method known in the art which can coat the treatment solution onto the wet recording layer (e.g., roll, spray or curtain) may also be used.

The coating amount of the recording layer may be adjusted as desired within a range in which the surface of the base paper is covered and sufficient ink absorption properties are obtained, but from the viewpoint of obtaining both recording density and ink absorption properties, it is preferred that it is 5–30 g/m$^2$ and particularly preferred that it is 10–25 g/m$^2$ in terms of solids on each surface. If 30 g/m$^2$ is exceeded, it is more difficult to remove the layer from the mirror surface and the recording layer sticks to the mirror surface. When a large coating amount is required, an undercoat may be provided between the support and the recording layer.

EXAMPLES

This invention will now be described in more detail by means of examples and comparative examples, but it should be understood that the invention is not to be construed as being limited in any way thereby. Unless otherwise specified, "parts" and "%" respectively referred to "wt parts" and "wt %".

Example 1

A support was manufactured by a paper machine from a pulp slurry manufactured by adding 10 parts of talc, 1.0 parts of aluminum sulfate, 0.1 parts of a synthetic sizing agent and 0.02 parts of a yield enhancing agent to a pulp comprising 100 parts of broad-leaved kraft pulp (L-BKP) with a beating degree of 285 ml. In this case, starch was applied to at least one surface so that the coating amount per surface was 2.5 g/m$^2$ in terms of solids, using a gate roller device. At the same time, the following coating solution A was applied to one surface to a dry coating weight of 7 g/m$^2$ by the blade method, and a base paper for use as an inkjet recording medium of weighting 190 g/m$^2$ was thus obtained.

Coating Solution A:

An aqueous coating solution of concentration 20% was prepared by blending 5 parts of latex (LX428C: Sumitomo Chemical Co., Ltd.), 20 parts of polyvinyl alcohol (PVA117: Kuraray Ltd.), and 5 parts of a sizing agent (Polymaron 360: Arakawa Chemical Industries Ltd.), with 100 parts of a synthetic silica (Finesil X-37: Tokuyama Corp.) as pigment.

The following coating solution B was then applied to the base paper obtained using a roll coater so that the dry coating amount was 20 g/m$^2$, solidified using the treatment solution (solidifying solution) C while the coated recording layer was still wet, and brought into pressure contact for 20 seconds with a mirror drum surface heated to 105° C. via a pressure roller to transfer a mirror finish so as to obtain an inkjet recording medium of 210 g/m$^2$.

Coating Solution B:

A coating solution of concentration 28% was prepared by blending 100 parts of a high purity alumina (AK)P-G015: Sumitomo Chemical Co., Ltd.) as pigment, 8 parts of polyvinyl alcohol (AH-22: Nippon Synthetic Chemicals Industry Co., Ltd.) and 0.3 parts of an antifoaming agent.

Coating Solution C:

A coating solution was prepared by blending borax/boric acid in a ratio of 1/1 at a concentration of 2% in terms of $Na_2B_4O_7$ and $H_3BO_3$, and blending 0.2% of a demolding agent (FL-48C: Toho Chemical Co., Ltd.).

Example 2

An inkjet recording medium was obtained in an identical manner to that of Example 1, except that the coating solution C used in Example 1 was replaced by the following treatment solution C'.

Coating Solution C':

A coating solution was prepared by blending borax/boric acid in a ratio of 2/1 at a concentration of 2% in terms of $Na_2B_4O_7$ and $H_3BO3$, and blending 0.2% of a demolding agent (FL-48C: Toho Chemical Co., Ltd.).

Example 3

An inkjet recording medium was obtained in an identical manner to that of Example 1, except that the coating solution B used in Example 1 was replaced by the following treatment solution B'.

Coating Solution B':

A coating solution was prepared by blending borax/boric acid in a ratio of 0.1/1 at a concentration of 2% in terms of $Na_2B_4O_7$ and $H_3BO_3$, and blending 0.2% of a demolding agent (FL-48C: Toho Chemical Co., Ltd.).

Example 4

An inkjet recording medium was obtained in an identical manner to that of Example 1, except that the coating solution C used in Example 1 was replaced by the following treatment solution C'.

Coating Solution C':

A coating solution was prepared by blending borax/boric acid in a ratio of 2.5/1 at a concentration of 2% in terms of $Na_2B_4O_7$ and $H_3BO_3$, and blending 0.2% of a demolding agent (FL-48C: Toho Chemical Co., Ltd.).

Example 5

An inkjet recording medium was obtained in an identical manner to that of Example 1, except that the coating solution B used in Example 1 was replaced by the following treatment solution B', and the coating solution C used in Example 1 was replaced by the following treatment solution C'.

Coating Solution B':

A coating solution of concentration 28% was prepared by blending 50 parts of high purity alumina (UA5605: Showa Denko Ltd.) and 50 parts of high purity alumina (AKP-G015: Sumitomo Chemical Co., Ltd.) as pigment, 10 parts of a resin comprising a polyvinyl alcohol A of average saponification degree 88.0 on and average polymerization degree 1700 (Denka Poval B-17: Denki Kagaku Kogyo Kabusiki Kaisya) and a polyvinyl alcohol B of average saponification degree 25.5 and average polymerization degree 2400 (PVA 624: Kuraray Ltd.) in a weight ratio A:B=1:1, and 0.2 parts of an antifoaming agent.

Coating Solution C':

A coating solution was prepared by blending borax/boric acid in a ratio of 0.25/1 at a concentration of 4% in terms of $Na_2B_4O_7$ and $H_3BO_3$, and blending 0.2% of a demolding agent (FL-48C: Toho Chemical Co., Ltd.).

Comparative Example 1

An inkjet recording medium was obtained in an identical manner to that of Example 1, except that the blending ratio of borax/boric acid in the treatment solution C used in Example 1 was 0/1.

Comparative Example 2

An inkjet recording medium was obtained in an identical manner to that of Example 1, except that the blending ratio of borax/boric acid in the treatment solution C used in Example 1 was 1/0.

Cast coat property, gloss and inkjet recording tests of the inkjet recording paper obtained in Examples 1–5, and Comparative Examples 1, 2 were performed as follows.

(1) Cast Coat Properties (a) Coatability:

The soiling of the treatment solution roller when the solution was applied by a cast coater was evaluated visually.

◎: No soiling of treatment solution roller

Δ: Due to incomplete solidification, a small amount of coating layer was transferred to the treatment solution roller.

×: Due to incomplete solidification, a large amount of coating layer was transferred to the treatment solution roller.

(b) Coating Solution Viscosity/Stability

◎: Solution can be coated even when left for 30 minutes or longer

×: When left for 30 minutes or longer, solution gels and cannot be coated.

(2) Gloss

The gloss of a cast coat paper surface was evaluated visually and as 20 degree mirror surface gloss. The measurement of 20 degree mirror surface gloss was performed according to JISZ 8741 by a gloss meter True Gloss GM-26PRO, Murakami Color Technology Research Labs.).

◎: Highly transparent gloss paper (20 degree mirror surface gloss was 20% or more)

Δ: Gloss was slightly less, as if cloudy (20 degree mirror surface gloss was less than 10–20%)

(3) Inkjet Recording Test

A recording test with pigment ink was performed by recording a predetermined pattern using an inkjet printer (MC-2000: Seiko Epson Ltd.), and for an inkjet recording test with dye ink, an evaluation was performed according to the following criteria using, as inkjet printer, BJF870J (Canon Ltd.).

(a) Ink Jet Absorption Properties (Bleeding) Smudging at the boundary between areas of different color was evaluated visually.

◎: Demarcation between different colors is clear

Δ: Slight smudging in color boundary area.

×: Marked smudging in color boundary area.

(b) Clarity of the Recorded Image was Evaluated Visually

◎: Clear

Δ: Clarity decreases slightly

×: Does not appear to be clear

The results are shown in Table 1.

TABLE 1

| | | Solidifying solution | | | | Recording properties | |
|---|---|---|---|---|---|---|---|
| | | | | | | Clarity | Ink absorption properties |
| | Coating solution | Borax/ boric acid | Concentration (%) | Coating properties | Gloss | Pigment ink/ dye ink | Pigment ink/ dye ink |
| Example 1 | C | 1/1 | 2.0 | ○ | ○ | ○/○ | ○/○ |
| Example 2 | C | 2/1 | 2.0 | ○ | ○ | ○/○ | ○/○ |
| Example 3 | B | 0.1/1 | 2.0 | Δ | Δ | Δ/○ | ○/○ |
| Example 4 | B | 2.5/1 | 2.0 | ○ | Δ | Δ/Δ | Δ/Δ |
| Example 5 | B | 0.25/1 | 4.0 | ○ | ○ | ○/○ | ○/○ |
| C. Example 1 | B | 0/1 | 2.0 | × | × | ×/Δ | ×/× |
| C. Example 2 | B | 1/0 | 2.0 | ○ | × | ×/Δ | ×/Δ |

As can be seen from Table 1, in Examples 1–5, an inkjet recording medium which had good coating properties, gloss and recording properties could be obtained. On the other hand, in Comparative Example 1 which used only boric acid as a treatment solution, solidification of polyvinyl alcohol was incomplete, a recording layer having satisfactory gloss was not obtained, and in particular, clarity when recording was performed with a pigment ink declined. Also, in Comparative Example 2 which used only borax as treatment solution, the mirror drum surface could not be transferred, gloss decreased, and recording properties declined for both pigment ink and dye ink.

Example 6

An inkjet recording medium was obtained in an identical manner to that of Example 5, except that 8 parts of a resin comprising a polyvinyl alcohol A of average saponification degree 88.0 and average polymerization degree 2400 (Kuraray 224: Kuraray Ltd.) and a polyvinyl alcohol B of average saponification degree 98.0 and average polymerization degree 2200 (AH-22: Nippon Synthetic Chemicals Industry Co., Ltd.) blended in a weight ratio A:B=3:1, was used as the binder in Coating Solution B'.

Example 7

An inkjet recording medium was obtained in an identical manner to that of Example 5, except that 5 parts of a resin comprising a polyvinyl alcohol A of average saponification degree 88.0 and average polymerization degree 2400 (Denka Poval: Denki Kagaku Kogyo Kabusiki Kaisya) and a polyvinyl alcohol B of average saponification degree 97.0 and average polymerization degree 2300 (MA23: Shin-Etsu Chemical Industries Ltd.) blended in a weight ratio A:B=5:2, was used as the binder in Coating Solution B'.

Example 8

An inkjet recording medium was obtained in an identical manner to that of Example 5, except that 20 parts of a resin comprising a polyvinyl alcohol A of average saponification degree 87.8 and average polymerization degree 1700 (GH- 17: Nippon Synthetic Chemicals Industry Co., Ltd.) and a polyvinyl alcohol B of average saponification degree 95.0 and average polymerization degree 1700 (PVA617: Kuraray Ltd.) blended in a weight ratio A:B=10:2, was used as the binder in Coating Solution B'.

Example 9

An inkjet recording medium was obtained in an identical manner to that of Example 5, except that 8 parts of a resin comprising a polyvinyl alcohol A of average saponification degree 88.0 and average polymerization degree 2000 (Denka Poval B-20: Denki Kagaku Kogyo Kabusiki Kaisya) and a polyvinyl alcohol B of average saponification degree 97.9 and average polymerization degree 2600 (AH-26: Nippon Synthetic Chemicals Industry Co., Ltd.) blended in a weight ratio A:B=1:1, was used as the binder in Coating Solution B'.

Example 10

An inkjet recording medium was obtained in an identical manner to that of Example 5, except that 23 parts of a resin comprising a polyvinyl alcohol A of average saponification degree 87.8 and average polymerization degree 1700 (GH17: Nippon Synthetic Chemicals Industry Co., Ltd.) and a polyvinyl alcohol B of average saponification degree 97.0 and average polymerization degree 2300 (MA23: Shin-Etsu Chemical Industries Ltd.) blended in a weight ratio A:B=2:1, was used as the binder in Coating Solution B'.

Comparative Example 3

An inkjet recording medium was obtained in an identical manner to that of Example 5, except that 10 parts of a resin comprising a polyvinyl alcohol A of average saponification degree 88.0 and average polymerization degree 1700 (Denka Poval: Denki Kagaku Kogyo Kabusiki Kaisya) and a polyvinyl alcohol B of average saponification degree 95.5 and average polymerization degree 2400 (PVA624: Kuraray Ltd.) blended in a weight ratio A:B=1:2, was used as the binder in Coating Solution B'.

Comparative Example 4

An inkjet recording medium was obtained in an identical manner to that of Example 5, except that 10 parts of a resin comprising a polyvinyl alcohol A of average saponification degree 87.8 and average polymerization degree 1700 (GH-17: Nippon Synthetic Chemicals Industry Co., Ltd.) and a polyvinyl alcohol B of average saponification degree 97.9 and average polymerization degree 2600 (AH-26: Nippon Synthetic Chemicals Industry Co., Ltd.) blended in a weight ratio A:B=13:2, was used as the binder in Coating Solution B'.

Comparative Example 5

An inkjet recording medium was obtained in an identical manner to that of Example 5, except that 10 parts of a resin comprising a polyvinyl alcohol A of average saponification degree 87.8 and average polymerization degree 1700 (GH-17: Nippon Synthetic Chemicals Industry Co., Ltd.) and a polyvinyl alcohol B of average saponification degree 99.4 and average polymerization degree 2600 (NH-26: Nippon Synthetic Chemicals Industry Co., Ltd.) blended in a weight ratio A:B= 1:1, was used as the binder in Coating Solution B'.

Comparative Example 6

An inkjet recording medium was obtained in an identical manner to that of Example 5, except that 10 parts of a resin comprising only a polyvinyl alcohol B of average saponification degree 99.4 and average polymerization degree 1700 (Denka Poval K-17C: Denki Kagaku Kogyo Kabusiki Kaisya), was used as the binder in Coating Solution B'.

Coating property, gloss and inkjet recording tests of the inkjet recording media obtained in Examples 5–10 and Comparative Examples 3–6, were performed as follows. The results are summarized in Table 2. For each test item, a mark of Δ or higher indicates that the product can be used without problem.

TABLE 2

| | Polyvinyl alcohol | | | | | | | |
|---|---|---|---|---|---|---|---|---|
| | Average polymerization degree A (average saponification degree 86–90)/ B (average saponification degree 95–98) | Blending ratio A (average saponification degree 86–91)/ B (average saponification degree 95–99) | Blending amount | Coating solution viscosity and stability | Coating properties | Gloss | Ink absorption properties | Clarity |
| Example 5 | 1700/2400 | 1/1 | 10 | ○ | ○ | ○ | ○ | ○ |
| Example 6 | 2400/2200 | 3/1 | 8 | ○ | ○ | ○ | ○ | ○ |
| Example 7 | 2400/2300 | 5/2 (=2.5/1) | 5 | ○ | ○ | ○ | ○ | ○ |
| Example 8 | 1700/1700 | 10/2 (=5/1) | 20 | ○ | ○ | ○ | ○ | ○ |
| Example 9 | 2000/2600 | 1/1 | 5 | ○ | ○ | ○ | ○ | Δ |
| Example 10 | 1700/2300 | 2/1 | 23 | ○ | Δ | Δ | Δ | ○ |
| C. Example 3 | 1700/2400 | 1/2 (=0.5/1) | 10 | × | × | × | ○ | ○ |
| C. Example 4 | 1700/2600 | 13/2 (=6.5/1) | 10 | ○ | Δ | × | ○ | ○ |
| C. Example 5 | 1700/2600* | 1/1* | 10 | × | ○ | Δ | Δ | ○ |
| C. Example 6 | 0/1700* | 0/1* | 10 | × | — | — | — | — |

*in the table indicates use of a polyvinyl alcohol having an average saponification degree of 99.4 or more —in the table indicates that measurement could not be performed because the solution could not be coated As can be seen from Table 2, the inkjet recording media obtained in Examples 5–10 had a good balance between coating solution viscosity and stability, coating properties, printing suitability and gloss, and were very satisfactory. If a polyvinyl alcohol having a low average polymerization degree was used, there was a slight deterioration in print clarity, and if the blending proportion is high, coating properties, gloss and ink absorption properties tended to decrease. Further, when a polyvinyl alcohol having an average saponification degree exceeding 98 was used, coating solution viscosity and stability become extremely poor, so coating could not be performed using this polyvinyl alcohol alone.

INDUSTRIAL APPLICATION

The inkjet recording medium of this invention has good cast coat properties, excellent ink absorption properties and clarity, and it permits high-quality inkjet recording to be performed with a gloss finish similar to that obtained with silver halide photograph printing paper. It is therefore of very great industrial importance.

What is claimed is:

1. An inkjet recording medium having a recording layer comprising a pigment and a polyvinyl alcohol, wherein the polyvinyl alcohol comprises 70% or more by weight of the total resin component of the recording layer, on an air-permeable support, wherein the inkjet recording medium is made by coating a treatment solution on the recording layer wherein the treatment solution has the action of solidifying the polyvinyl alcohol when it is in the wet state, and then bringing the recording layer into pressure contact with a heated mirror surface while it is still wet, this treatment solution comprising a mixed solution of a borate and boric acid, wherein the blending ratio of the borate and boric acid in the treatment solution is 0.25/1–2/1, by weight ratio.

2. The inkjet recording medium according to claim 1, wherein the polyvinyl alcohol is a mixture of a polyvinyl alcohol (A) having an average saponification degree of 86–90 and a polyvinyl alcohol (B) having an average saponification degree of 95–98.

3. The inkjet recording medium according to claim 2, wherein the weight ratio of the polyvinyl alcohol (A) having an average saponification degree of 86–90 and the polyvinyl alcohol (B) having an average saponification degree of 95–98, is A:B=1:1–5:1.

4. The inkjet recording medium according to claim 3, wherein the pigment in the recording layer comprises an alumina compound.

5. The inkjet recording medium according to claim 2, wherein the pigment in the recording layer comprises an alumina compound.

6. The inkjet recording medium according to claim 1, wherein the average polymerization degree of the polyvinyl alcohol is 1,700–2,800.

7. The inkjet recording medium according to claim 1, wherein the pigment in the recording layer comprises an alumina compound.

8. The inkjet recording medium according to claim 1, wherein the air-permeable support comprises paper.

9. The inkjet recording medium according to claim 8, wherein the paper is made from a chemical pulp, a mechanical pulp, or a de-inked pulp.

10. The inkjet recording medium according to claim 1, wherein the polyvinyl alcohol comprises 80% or more by weight of the total resin component of the recording layer.

11. The inkjet recording medium according to claim 1, wherein the resin component in the recording layer is 5–30 weight parts relative to 100 weight parts of pigment.

12. The inkjet recording medium according to claim 1, wherein the recording layer further comprises a remover.

13. The inkjet recording medium according to claim 1, wherein the treatment solution further comprises a remover.

14. The inkjet recording medium according to claim 1, wherein the total resin component of the recording layer comprises a starch, carboxymethylcellulose, hydroxyethylcellulose, polyvinyl pyrrolidone, a casein, a gelatine, a soybean protein, a styrene-acryl resin, a styrene-butadiene latex, an acryl emulsion, a vinyl acetate emulsion, a vinyl chloride emulsion, a urethane emulsion, a urea emulsion, or an alkyd emulsion.

15. The inkjet recording medium according to claim 1, wherein the resin component in the recording layer is 5–30 weight parts relative to 100 weight parts of the pigment.

16. The inkjet recording medium according to claim 1, wherein the borate comprises borax.

17. A process for preparing an inkjet recording medium having a recording layer comprising a pigment and a polyvinyl alcohol on an air-permeable support, comprising:

pressure contacting the recording layer, wherein the polyvinyl alcohol comprises 70% or more by weight of the total resin component of the recording layer, coated with a treatment solution comprising a borate and a boric acid when wet with a heated mirror surface, wherein the blending ratio of the borate and boric acid in the treatment solution is 0.25/1–2/1, by weight ratio.

18. A process according to claim 17, wherein the pressure contacting is for 20 seconds.

19. A process according to claim 17, wherein the temperature of the heated mirror surface is about 105° C.

20. A process according to claim 7, wherein the borate comprises borax.

* * * * *